US011172743B2

(12) United States Patent
Igarashi et al.

(10) Patent No.: US 11,172,743 B2
(45) **Date of Patent: *Nov. 16, 2021**

(54) MOBILE ELECTRONIC DEVICE CASE

(71) Applicants: Tadashi Igarashi, Tokyo (JP); Kenichi Shibata, Tokyo (JP); Tracy Heims, Seattle, WA (US)

(72) Inventors: Tadashi Igarashi, Tokyo (JP); Kenichi Shibata, Tokyo (JP); Tracy Heims, Seattle, WA (US)

( * ) Notice: Subject to any disclaimer, the term of this patent is extended or adjusted under 35 U.S.C. 154(b) by 169 days.

This patent is subject to a terminal disclaimer.

(21) Appl. No.: 16/392,876

(22) Filed: Apr. 24, 2019

(65) Prior Publication Data

US 2019/0246757 A1 Aug. 15, 2019

Related U.S. Application Data

(63) Continuation of application No. PCT/US2018/021896, filed on Mar. 10, 2018, and a continuation of application No. 15/456,385, filed on Mar. 10, 2017, now Pat. No. 10,314,376.

(51) Int. Cl.

| | |
|---|---|
| ***A45C 13/00*** | (2006.01) |
| ***A45C 11/00*** | (2006.01) |
| ***A45F 5/00*** | (2006.01) |

(52) U.S. Cl.

CPC ..... *A45C 11/00* (2013.01); *A45C 13/002* (2013.01); *A45F 5/00* (2013.01); *A45C 2011/001* (2013.01); *A45C 2011/002* (2013.01); *A45C 2011/003* (2013.01)

(58) Field of Classification Search

CPC . A45C 11/00; A45C 13/002; A45C 2011/001; A45C 2011/002; A45C 2011/003

USPC ..... 206/320

See application file for complete search history.

(56) References Cited

U.S. PATENT DOCUMENTS

| | | | | |
|---|---|---|---|---|
| 2012/0328905 | A1* | 12/2012 | Guo | C21D 8/0294 428/687 |
| 2013/0334072 | A1* | 12/2013 | Rayner | G06F 1/1633 206/37 |
| 2014/0346078 | A1* | 11/2014 | Chang | A45C 11/00 206/521 |
| 2015/0195938 | A1* | 7/2015 | Witter | G06F 1/1656 206/521 |

* cited by examiner

*Primary Examiner* — King M Chu

(74) *Attorney, Agent, or Firm* — Tracy M Heims; Apex Juris, pllc.

(57) ABSTRACT

A case for a mobile, electronic device, the case having a hard, clear case body with an outer surface and an inner surface facing the electronic device and at least one separator on the inner surface of the case body to create a space between the electronic device and the case body.

18 Claims, 14 Drawing Sheets

MOBILE ELECTRONIC DEVICE CASE

PRIOR APPLICATION PRIORITY

This application claims priority to previously filed U.S. patent application Ser. No. 15/456,385 filed on Mar. 10, 2017 and to previously filed PCT application number PCT/US18/21896 filed on Mar. 10, 2018, both incorporated by reference herein.

BACKGROUND OF THE INVENTION

Currently there are numerous electronic mobile devices, such as mobile phones, tablets, phablets, cameras, laptop computers, music players, and a multitude of other devices that currently exist and those that have yet to be invented, that fill our lives with enjoyment, pleasure, and that are used to work, create, organize, and everything in between. These devices come in a wide variety of colors, shapes and sizes and designers and manufacturers are constantly looking for something different and appealing to attract and keep old and new consumers. One way that these manufacturers and designers offer something different is in the outside covering material used for the device. Recently there has been a move to a shiny surface that provides a lustrous, glossy look. This is a very attractive look but it provides a new set of problems. First and foremost, the material tends to scratch and scuff easily. This material also tends to show fingerprints and dirt more easily. Consumers and users like to keep their devices looking new and thus wish to apply a case or covering to protect the device's outer surface material, but they still wish to show off the gloss finish. Now, because of this material and the resultant problems associated with the material, there exists a need to have a covering, coating, or case that will protect this clear, shiny device surface while still being able to show off the shiny, high glossy surface.

The main problem that exists is the creation of a clear case that can snugly cover and protect the device. There are many clear materials that can be used as the protective clear case such as plastic materials and glass. The most common materials with which to manufacture such cases is a clear plastic material, such as a polycarbonate or acrylic. The problem with these materials, however, is that when they are used as a case for a device with a shiny, clear surface they reveal a type of water mark. That is, when the shiny, glossy device surface contacts the inner, clear, shiny surface of the polycarbonate or acrylic case the two hard surfaced materials touch and this solid plastic on plastic contact creates an unwanted glossy, wet look, or water mark. This occurs no matter what type of device is used. That is, it could be mobile phone, a tablet, a computer, or any other type of portable mobile device. As long as the device has the glossy finish the water mark is going to be visible.

SUMMARY OF THE INVENTION

This invention resolves the above-described water marking issue that occurs when a clear, protective case is used to cover a shiny, clear surface of an electronic device. More specifically, this invention provides a clear protective case that creates a slight space, or minimal separation between the shiny surface of the device and the attaching surface of the case where the minimal separation eliminates the water marking effect.

DETAILED DESCRIPTION OF THE INVENTION

To address the above referenced problems the present invention is created. The best solution found so far to prevent this water mark is to create a minimal separation between the device and the case. The question to be answered is how to do this without causing too great of a gap and how to keep dirt and dust from entering the space.

The present invention provides a case 10 for a mobile, electronic device, where the case 10 has a rigid case body mainly made of a substantially hard material, typically plastic, having an outer surface 14 and an inner surface 12 facing the electronic device, at least one access hole 16 configured to matingly align with electronic device controls, and at least one separator on the inner surface 12 of the case body to create a space between the electronic device and the case body inner surface 12.

Figure 1:
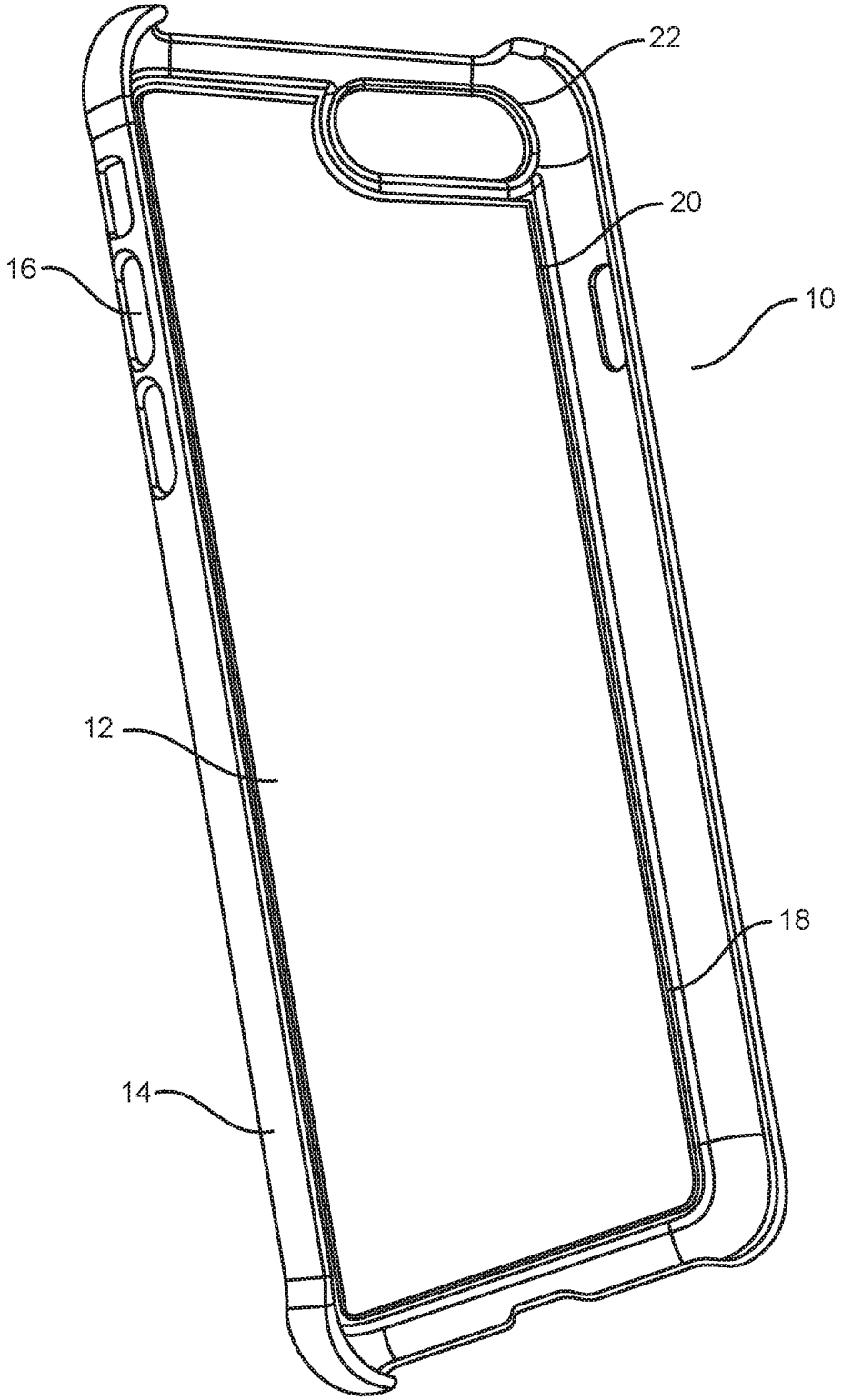
FIG. 1 is an elevated view of a first embodiment of the case of the present invention using the solid ridge around the periphery of the case and around the camera lens and flash opening.
Figure 2:
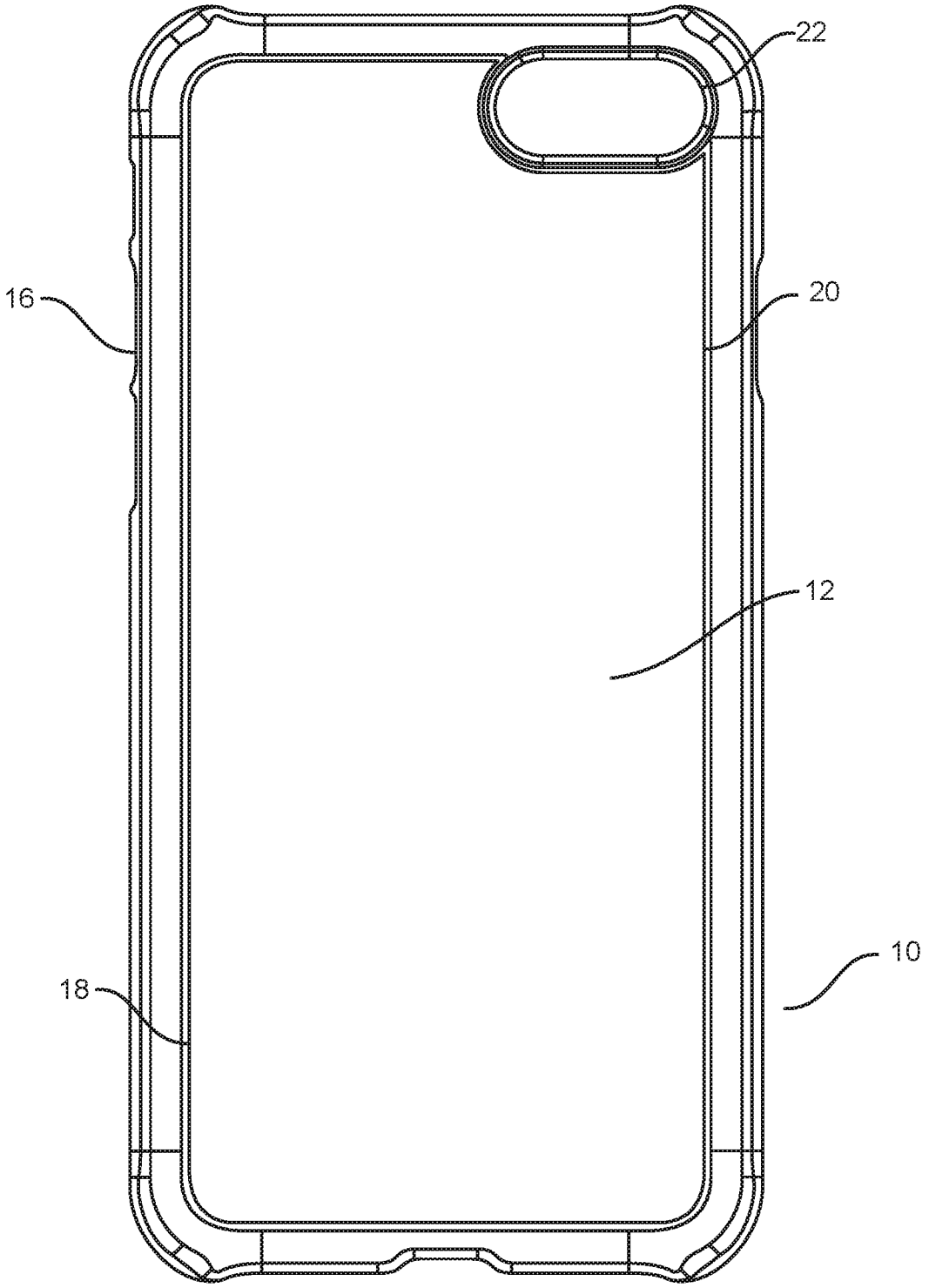
FIG. 2 is a plan view of the inside of the case of the first embodiment of the case of the present invention using the solid ridge around the periphery of the case and around the camera lens and flash opening.

FIGS. 1 through 20 show preferred embodiments of this invention. FIG. 1 is a perspective and FIG. 2 is a plan view of the first embodiment where the separator is a ridge 20 or rib formed on the inner surface 12 about the periphery 18 of the case 10. In this embodiment, the separator ridge 20 is formed on the inner surface 12 and along an outer edge, or periphery 18 of the case near the corner that wraps around the inner edge of the case, thereby creating a raised rib around the entire periphery 18 of the inner surface 12 of the case 10. The peripheral rib, or ridge 20 preferably attaches to the surface of the device or is formed from the same material as the surface of the device, and because of the height of the ridge, a minimal space is created between the inner surface 12 of the case 10 and the facing surface of the device. The minimum height of the separator in the form of the circled, or encompassing rib can be approximately between 0.15μ and 0.35μ. This way the ridge 20 encompasses the entire periphery 18 of the case 10, forming an encapsulating ridge that prevents dirt and dust from entering the space now formed between the device and the case 10. Also in this embodiment, another or second separator is formed around the periphery of the camera or camera lens and/or flash hole that wraps around the camera lens/flash opening of the case. This second separator 22 encircles the entire periphery of the camera lens/flash opening of the case 10, forming an encapsulating ridge that prevents dirt and dust from entering therefrom. Additional separator or separators may be formed on any other inner surface portion of the case to close the space between the case and the device as desired to prevent dirt and dust from entering the space created by the separator.

Figure 3:
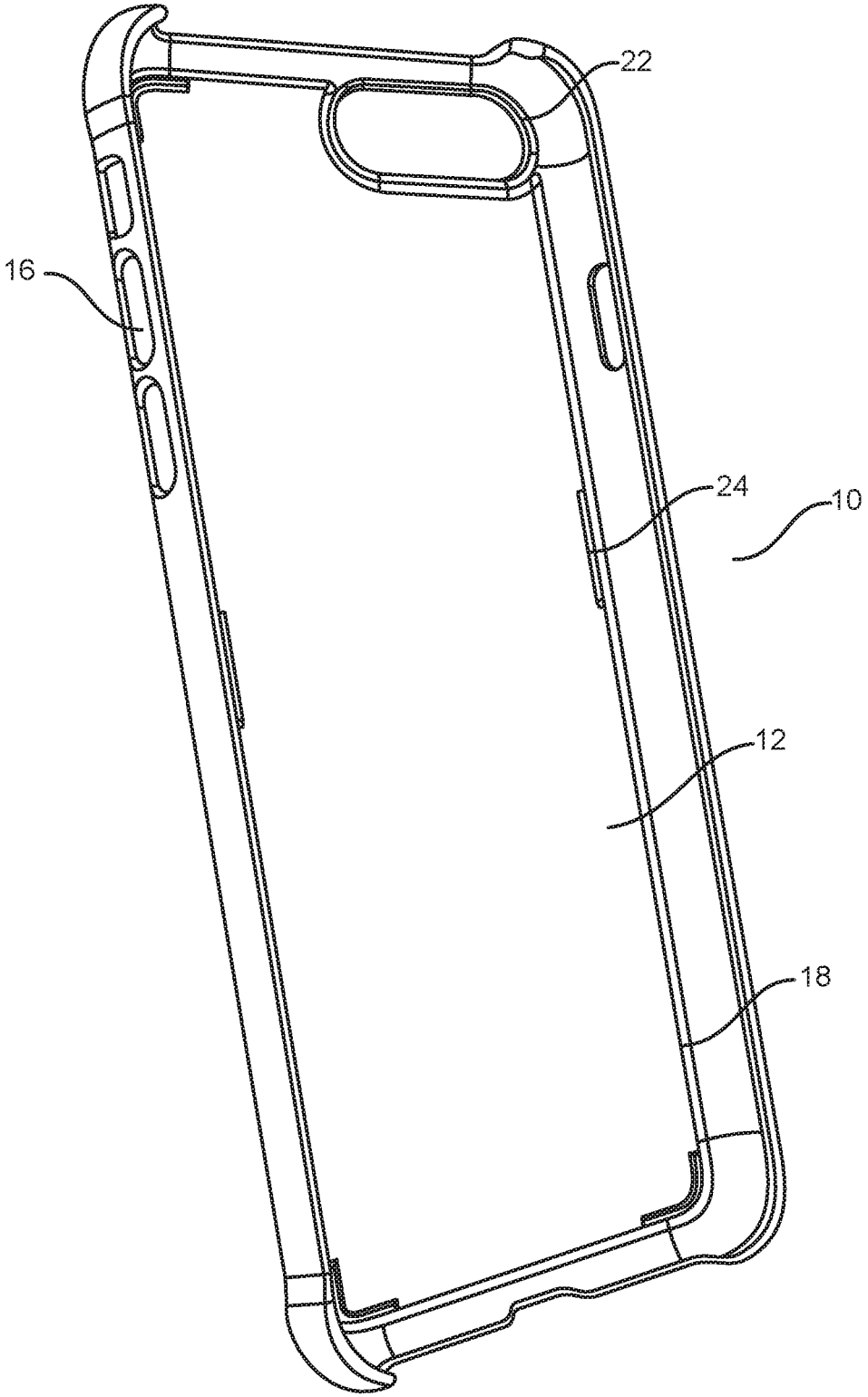
FIG. 3 is an elevated view of a second embodiment of the case of the present invention using a dotted line ridge around the periphery of the case and around the camera lens and flash opening.
Figure 4:
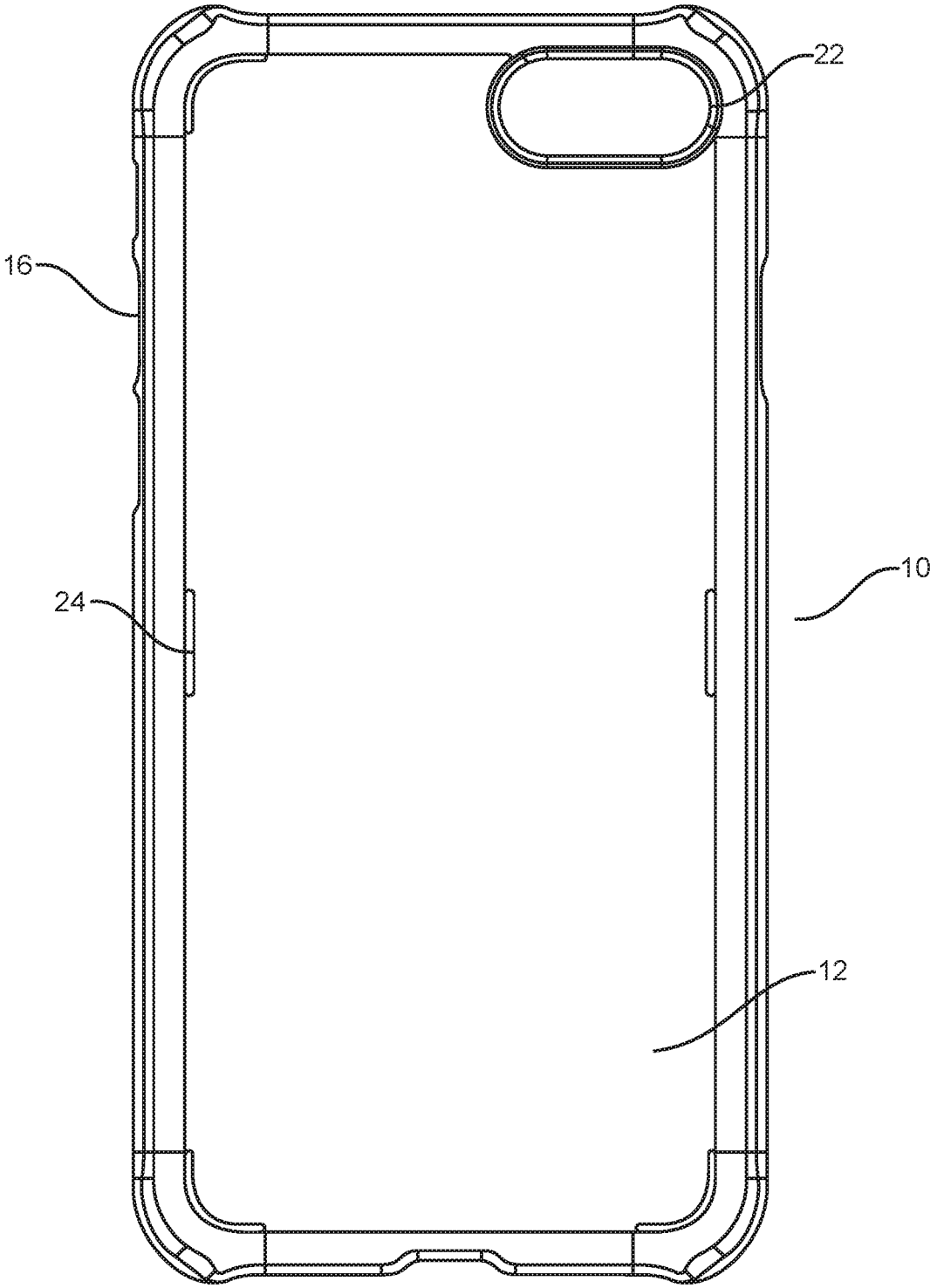
FIG. 4 is a view of the inside of the case of the second embodiment of the present invention using the dotted line ridge around the periphery of the case and around the camera lens and flash opening.
Figure 5:
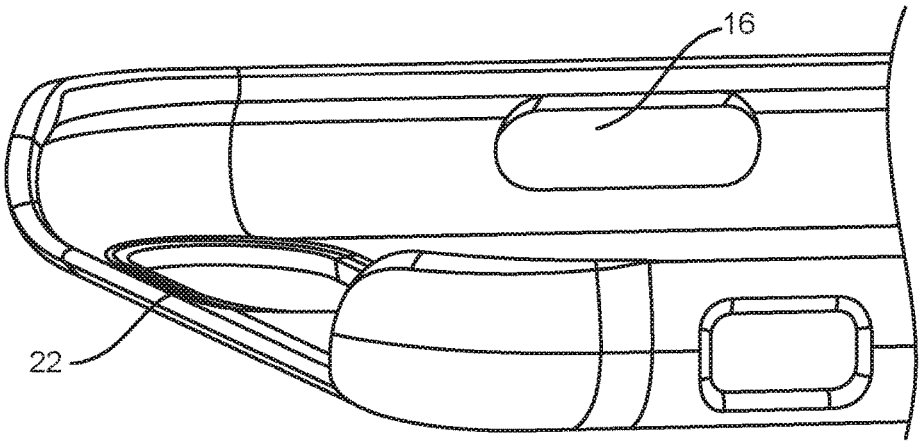
FIG. 5 is a perspective view of a first end of the case of the present invention.
Figure 6:
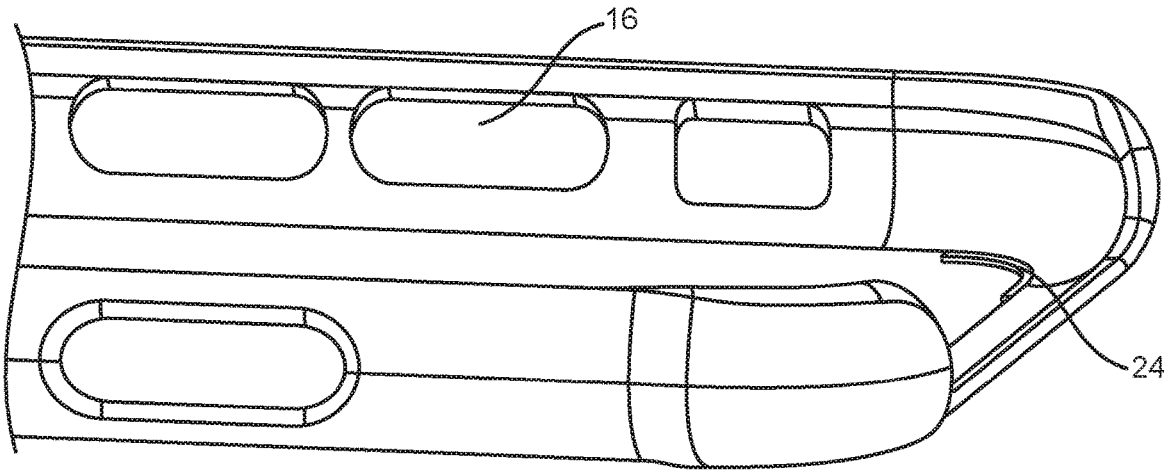
FIG. 6 is a perspective view of a second end of the case of the present invention.
Figure 7:
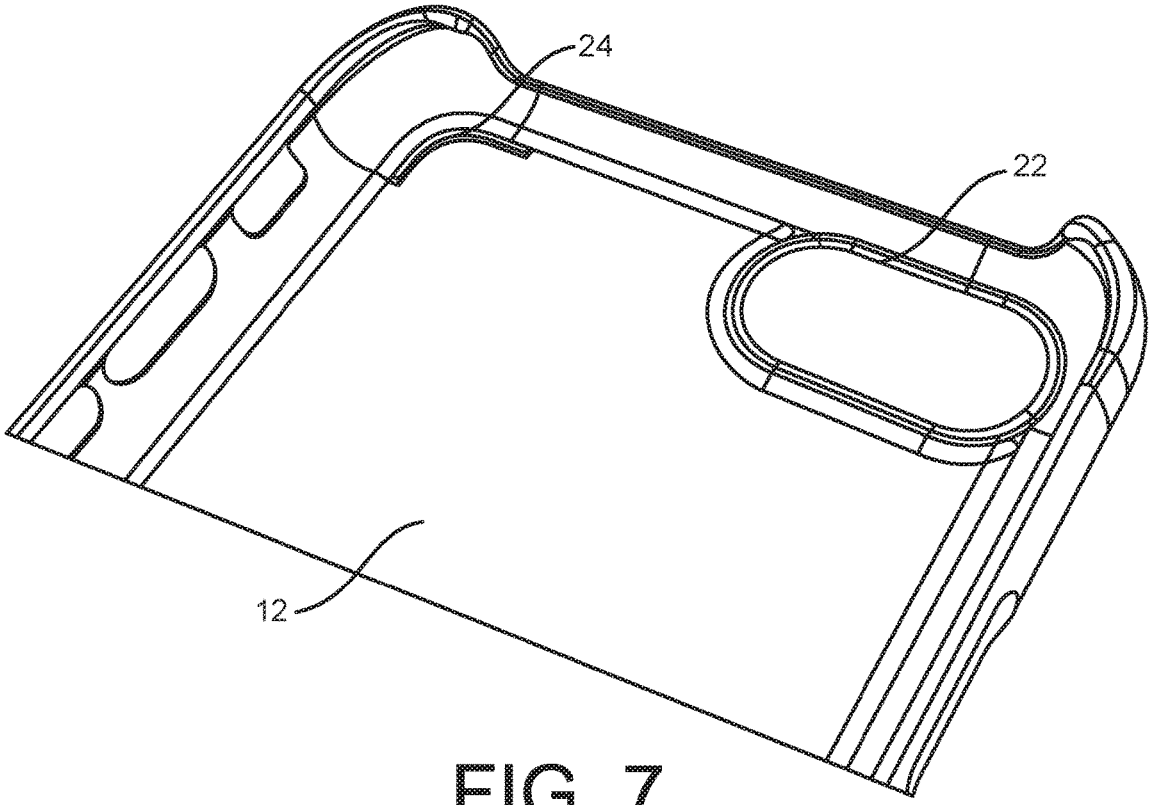
FIG. 7 is an elevated view of the first end of the case showing the camera hole and flash opening and corner ridges.
Figure 8:
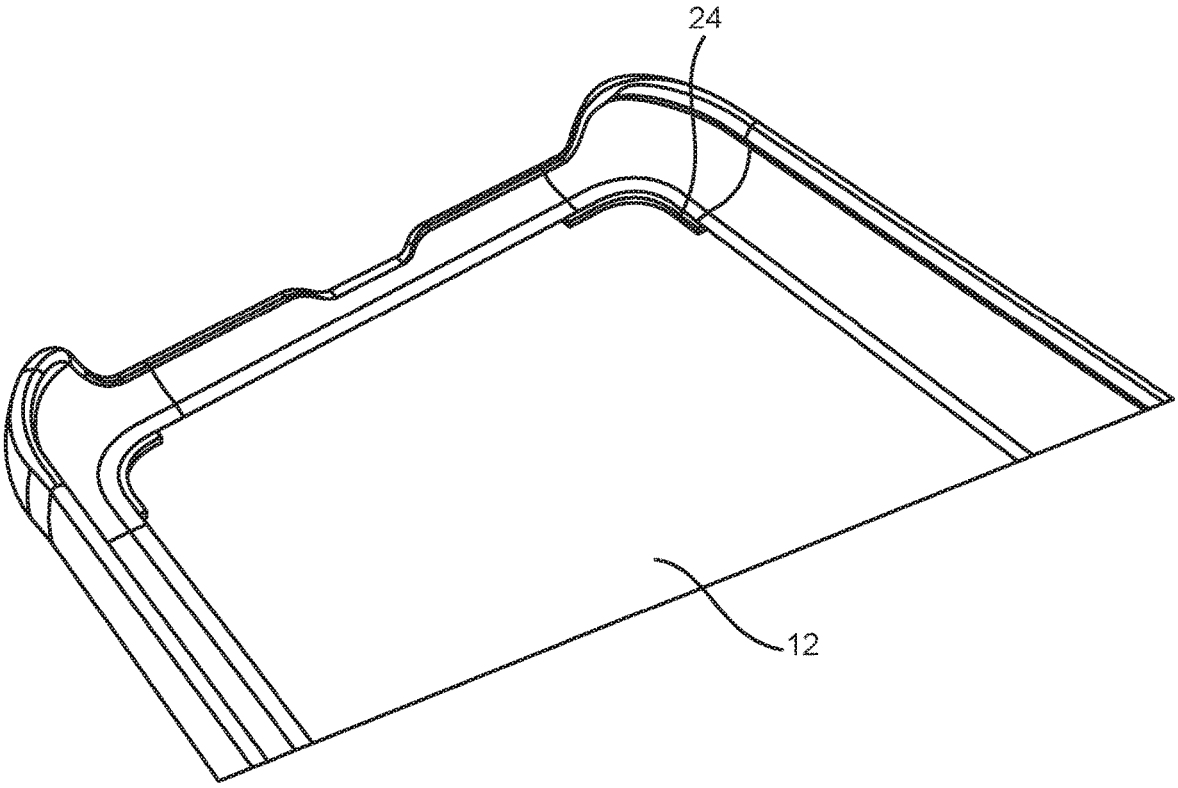
FIG. 8 is an elevated view of the second end of the case.

FIG. 3 is a perspective view and FIG. 4 is a plan view of the second embodiment of this invention, where the separator is formed from multiple ribs or ridges 24 on desirable inner positioning surface 12 portions of the case 10. So far as an effectiveness in removing the water mark, the separator may be effective as long as it creates a slight space or gap between the surface of the device and the attaching surface of the case. In addition to the multiple ribs 24, another separator or separators may be formed on any other inner surface portion of the case to close the space between the case and the device as desired to prevent dirt and dust from entering the space. FIGS. 5-8 are end views of the second embodiment.

Figure 9:
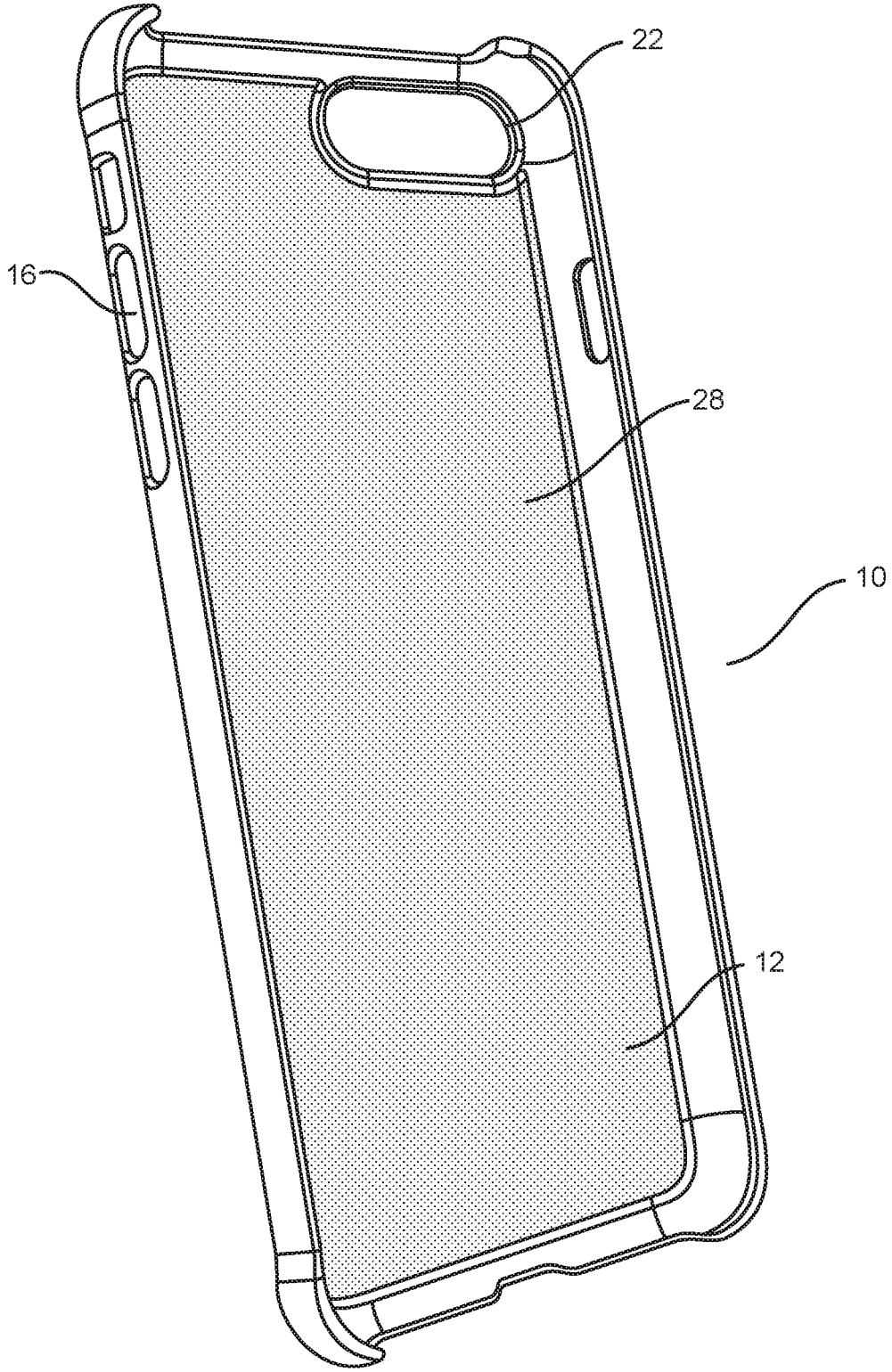
FIG. 9 is an elevated view of the third embodiment of the case of the present invention with the microdot configuration.
Figure 10:
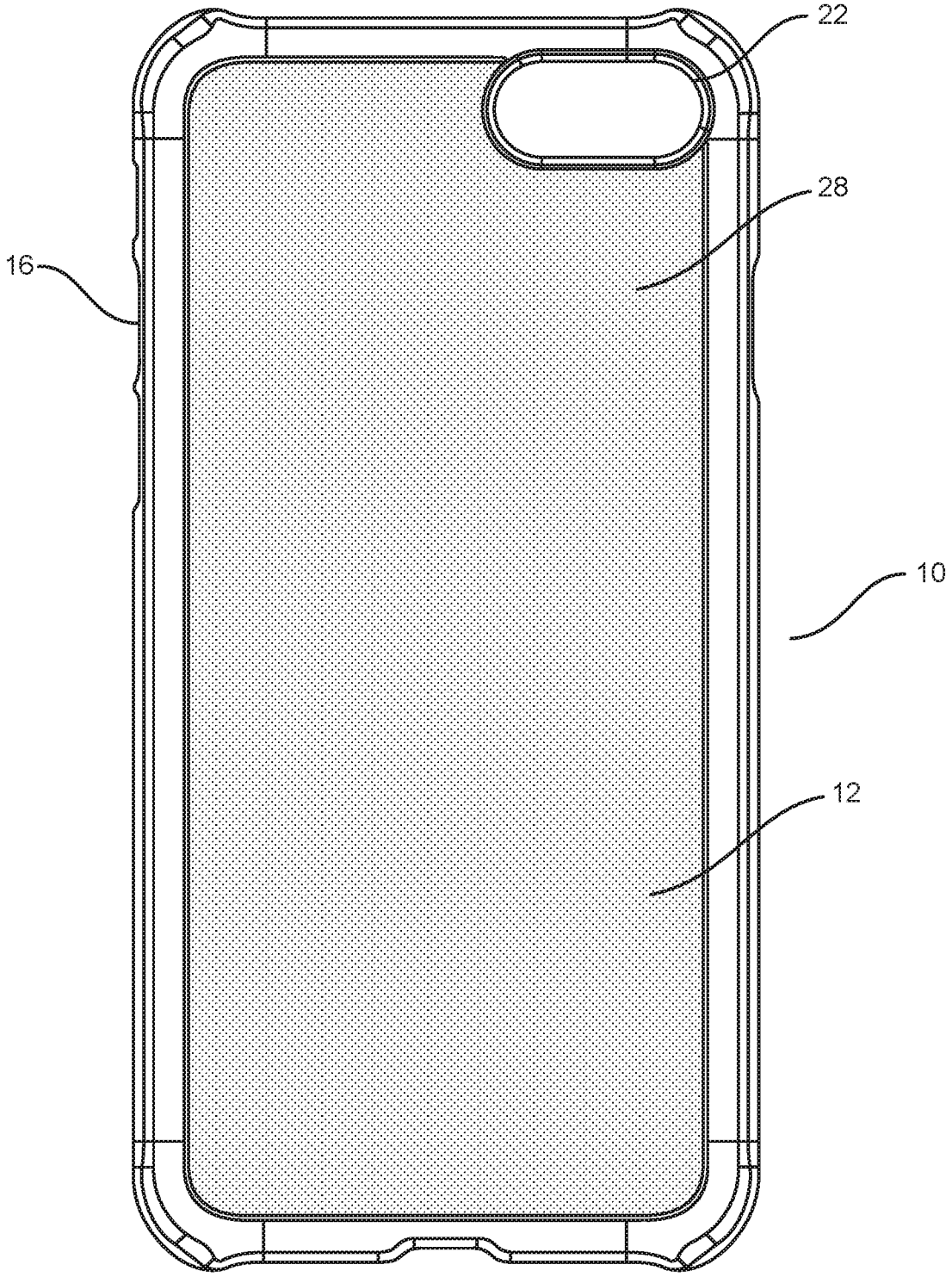
FIG. 10 is an elevated view of the third embodiment of inside of the case with the microdot configuration.
Figure 11:
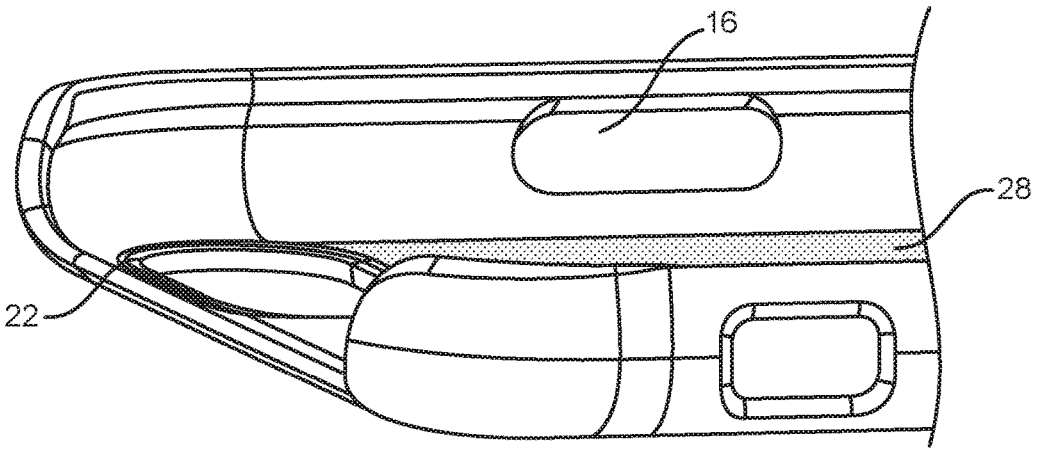
FIG. 11 is a perspective view of the first end of the case of the third embodiment microdot configuration.
Figure 12:
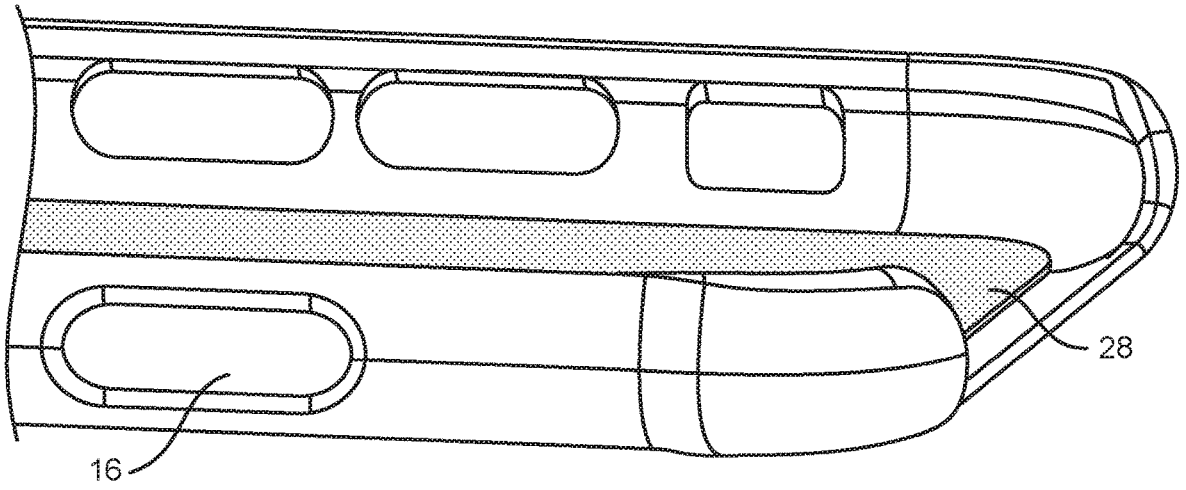
FIG. 12 is a perspective view of the second end of the case of the third embodiment microdot configuration.
Figure 13:
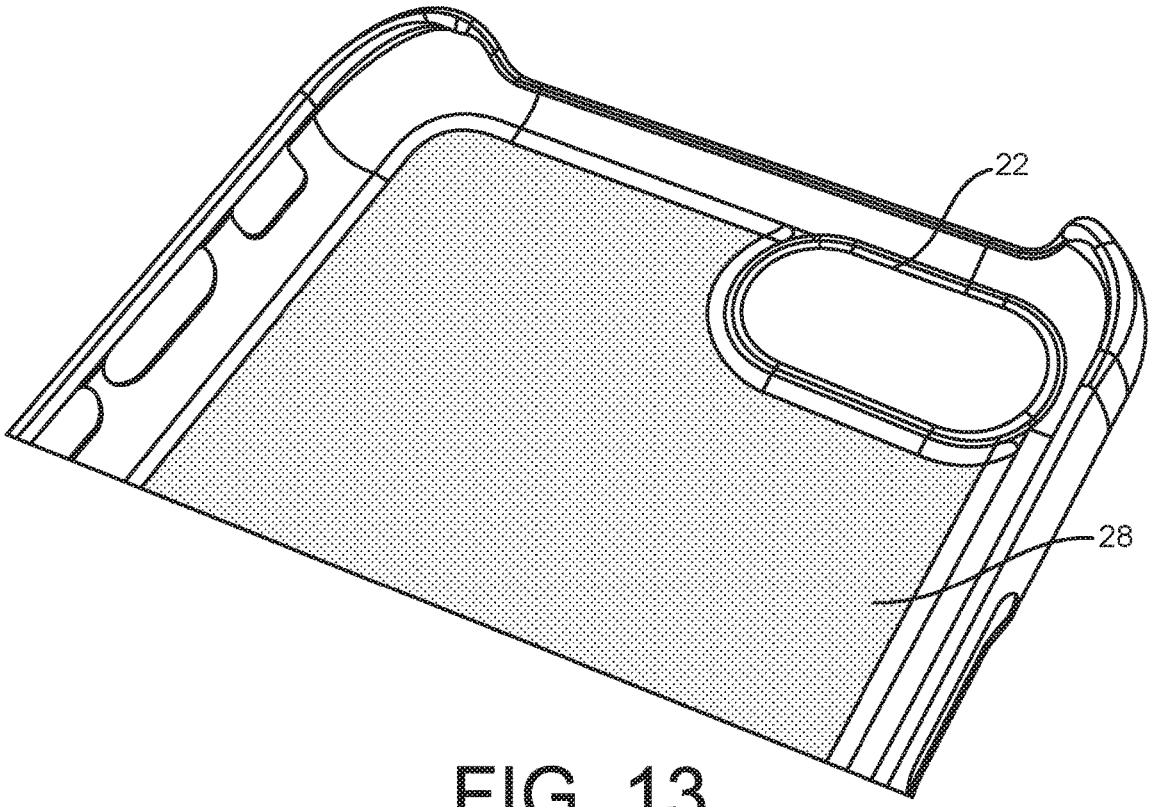
FIG. 13 is an elevated partial view of the first end of the case of the third embodiment using the microdot configuration.
Figure 14:
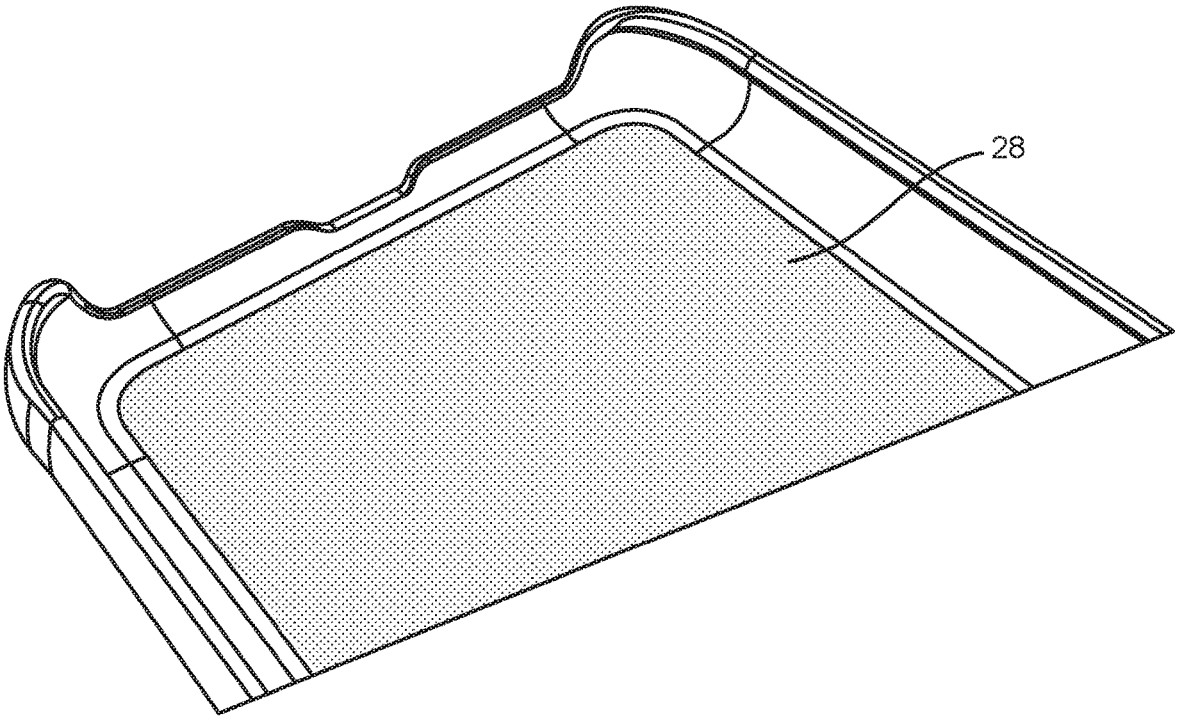
FIG. 14 is an elevated partial view of the case of the third embodiment using the microdot configuration.

FIG. 9 is a plan view of the third embodiment of this invention. FIG. 10 is a plan view of this third embodiment. In this invention, the separator could be in the form of numerous micro dots 28 formed on the entire inner surface 12 of the case 10 that face the back surface of the device. Numbers and sizes of the dots 28 may vary and they can be uniformly or randomly placed as long as they create a minimal space between the inner surface of the case and the facing surface of the device. It is preferable to have minimally sized dots 28 so as to maintain the maximum transparency and clarity of the case. In addition to the multiple dots 28, a separator or separators may be formed on any other inner surface portion of the case to close the space between the case and the device as desired to prevent dirt and dust from entering the space.

FIGS. 11 through 14 are various views of the ends of the third embodiment.

Figure 15:
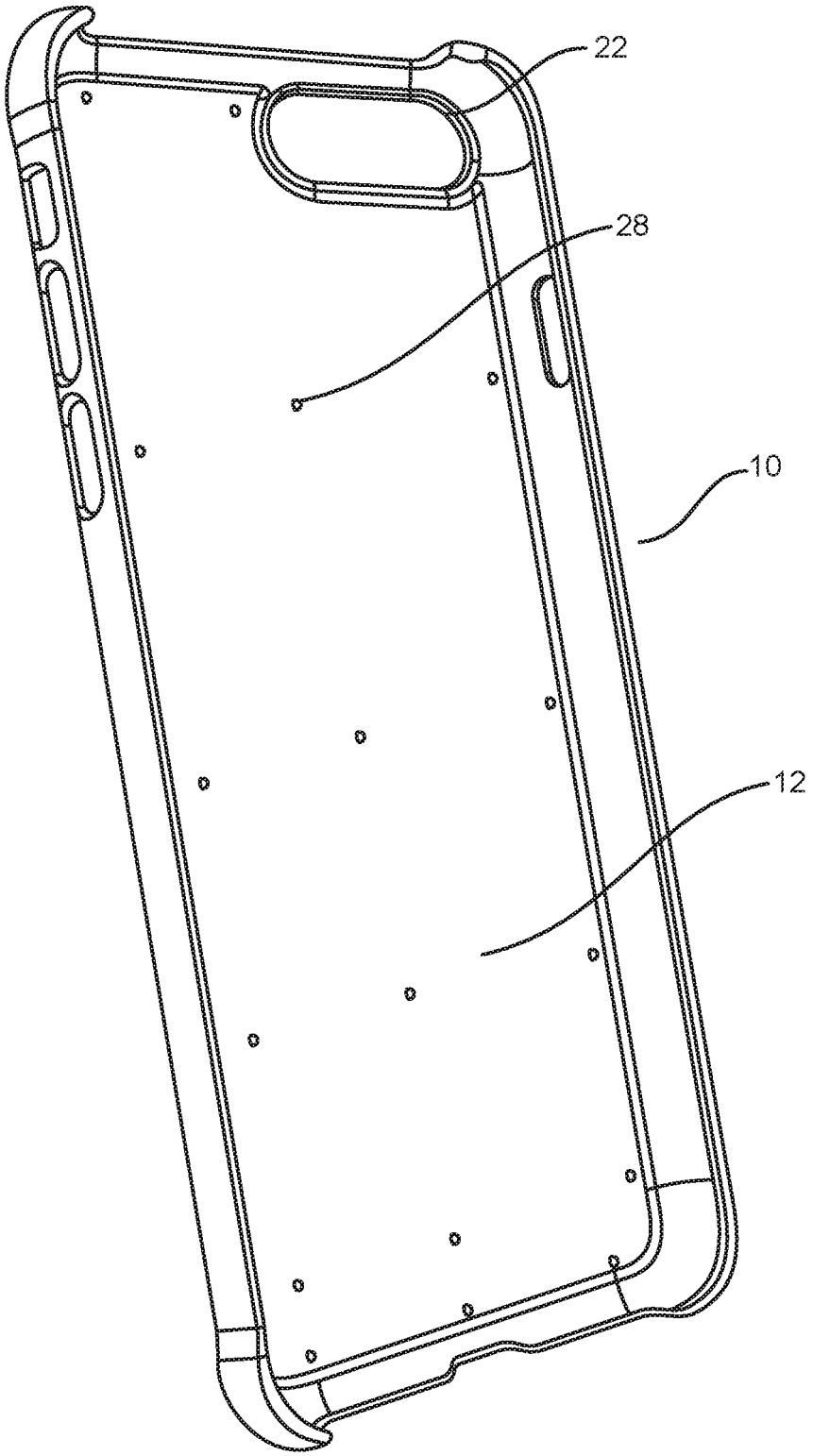
FIG. 15 is an elevated view of the case of a fourth embodiment, second end, using the modified microdot configuration.
Figure 16:
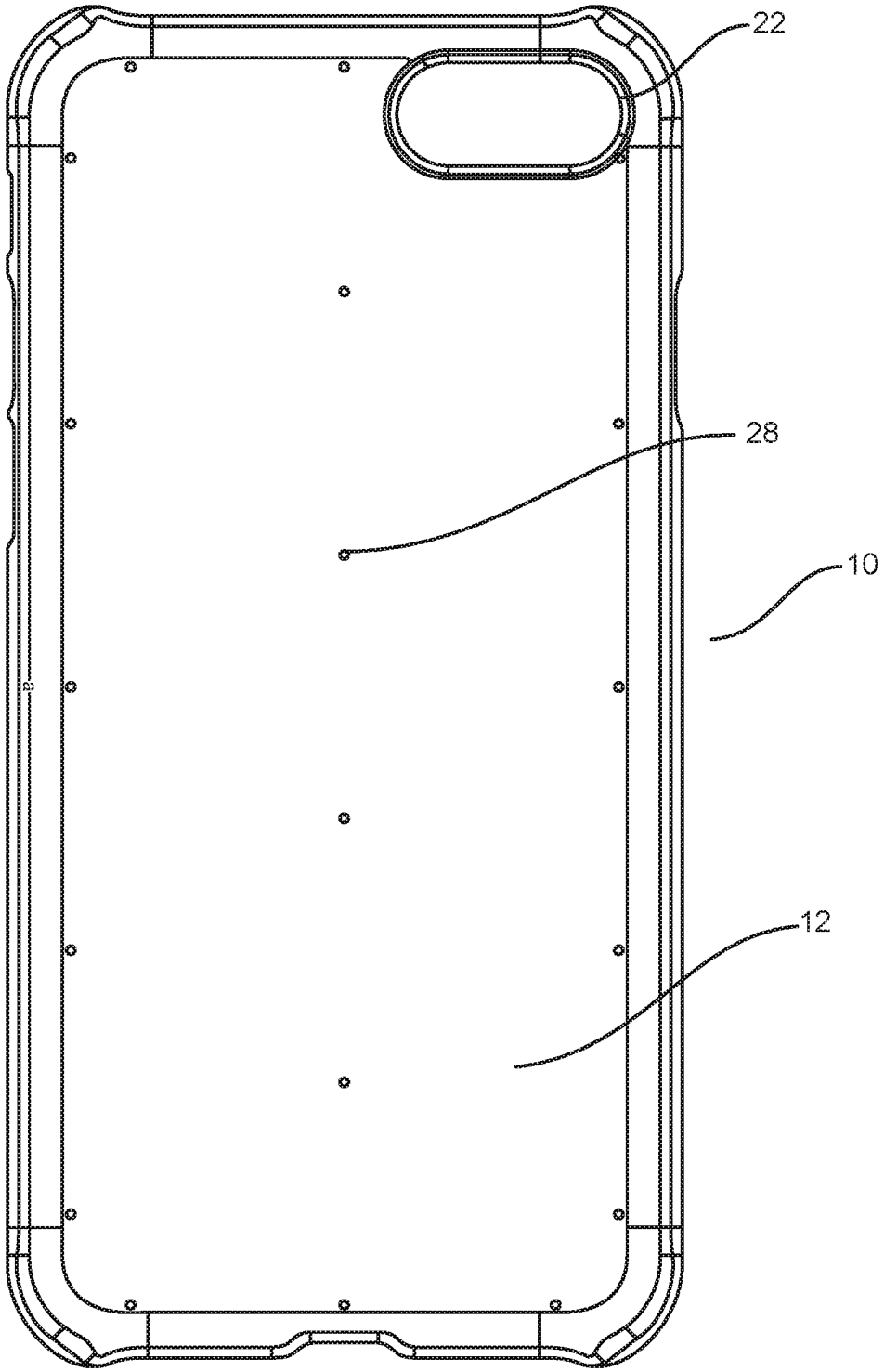
FIG. 16 is an elevated perspective view of the case of the fourth embodiment using the modified microdot configuration.
Figure 17:
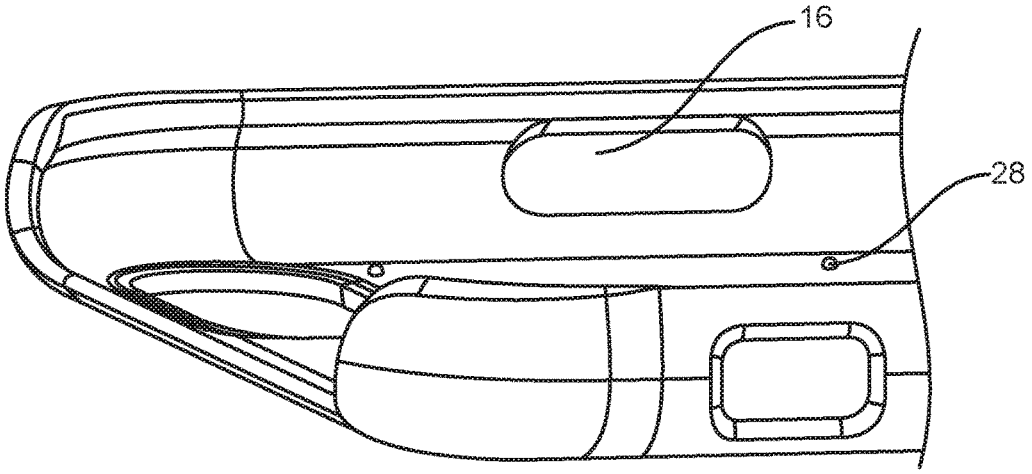
FIG. 17 is a perspective view of the first end of the fourth embodiment using the modified microdot configuration.
Figure 18:
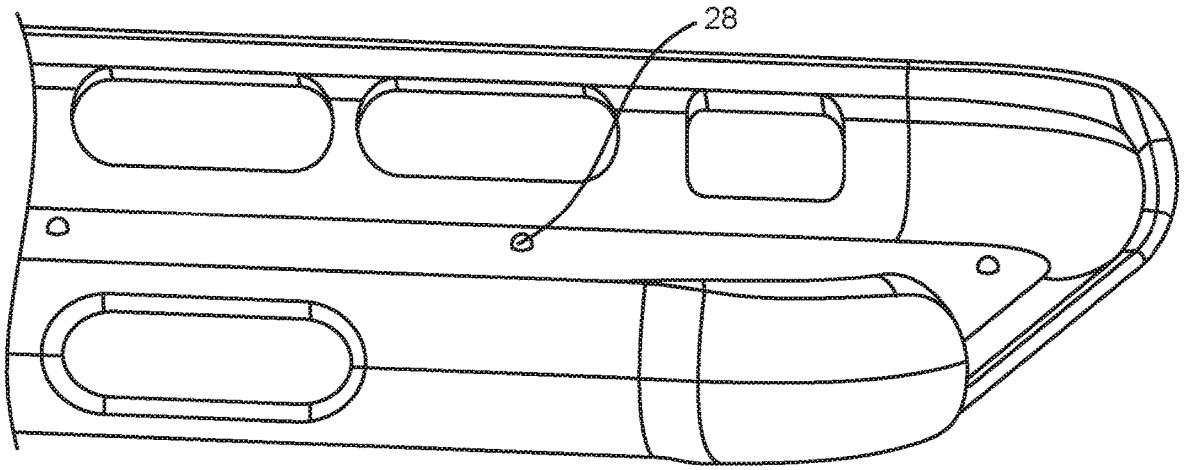
FIG. 18 is a perspective view of the second end of the fourth embodiment using the modified microdot configuration.
Figure 19:
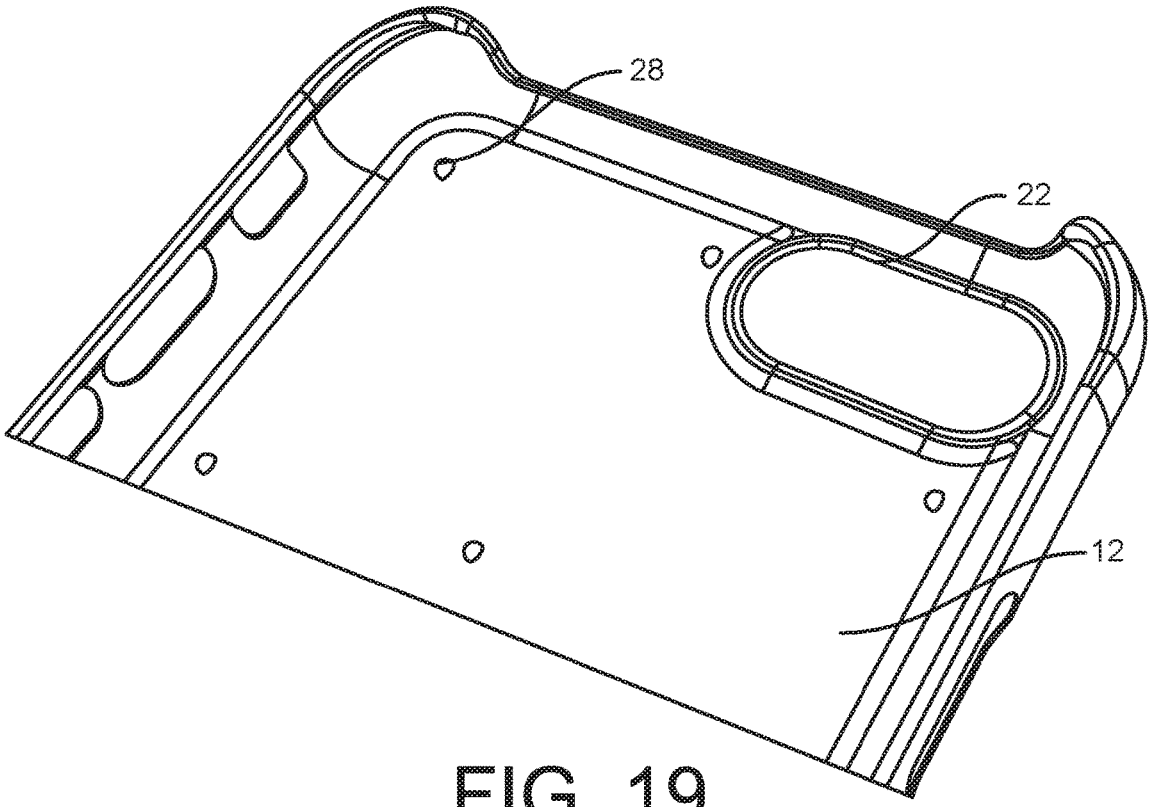
FIG. 19 is elevated perspective view of the first end of the fourth embodiment using the modified microdot configuration.
Figure 20:
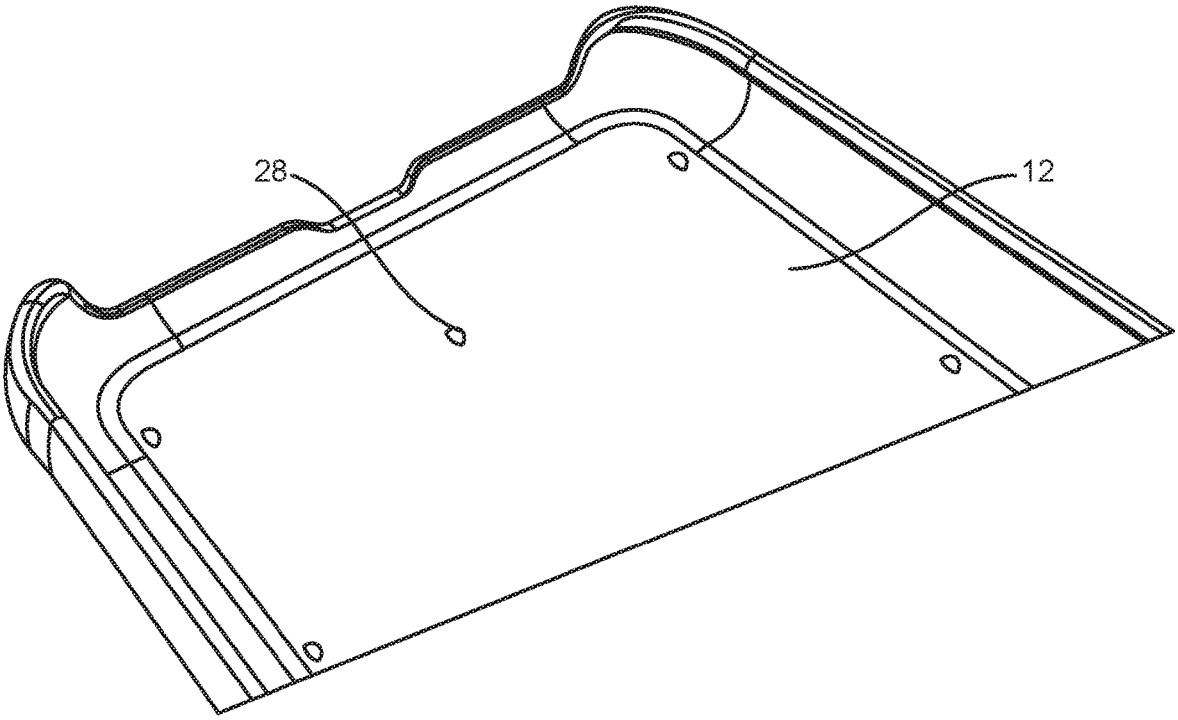
FIG. 20 is elevated perspective view of the second end of the fourth embodiment using the modified microdot configuration

FIG. 15 is a perspective view and FIG. 16 is a plan view of the fourth embodiment of this invention. In this invention, the separator could be in the form of multiple dots 28 formed on the selected portions on the inner surface 12 of the case 10. They could be in a line, or a pattern or any other configuration. Numbers and sizes of the dots 28 may vary, they can be uniformly or randomly placed, as long as they create a minimal space between the inner surface 12 of the case 10 and the facing surface of the device they will be effective in resolving and eliminating the water mark problem. It is preferable to form the dots in minimal size so as to maintain the maximum transparency and clarity of the case. In addition to the multiple dots 28, a separator or separators may be formed on any other inner surface portion of the case to close the space between the case and the device as desired to prevent dirt and dust from entering the space.

There are several ways to create the separator and it doesn't matter if the separator is a ridge, rib or a microdot. This first is to make the ridge or rib an integral part of the case itself. Typically, the case is made of a substantially solid plastic, such as poly-carbonate or acrylic. It is preferred to have the ridge or rib separator built into the case mold when the case is made so that the ridge is actually an integral part of the case itself and is made from the same material as the rest of the case.

Alternatively, the material can be different from the actual case material. For example, the rib or ridge separator could be made from something slightly softer, such as Thermoplastic Urethane, or TPU, or any other softer material. If a different material is used the material becomes a part of the case but the way that it is manufactured is different. This takes additional time and an additional, different material, and therefore costs more. However, the softer material can function as a shock absorbing portion which may protect the device when it is dropped.

Finally, the minimum height of the separator in the form of numerous micro dots can be approximately between 2μ and 5μ. In this configuration, with microdots covering most of the case surface, at 2 microns there are few water marks. At 3 microns there is a slight water marking, at 4 microns there is almost no water marking and at 5 micron the water markings completely disappear. When there are minimum dots, such as those in the alternative embodiments with dots down the middle and outside of the case only if the microdots are at 0.1 mm there is still a water mark present. At 0.2 mm there is almost no water mark present and at 0.3 mm there is no water mark. Finally, the minimum height of the separator in the form of the circled, or encompassing rib or ridge can be approximately between 0.15μ and 0.35μ. It has been found that if the rib is not at least this high that it does not create enough separation and thus the water mark still occurs. It is noted that the above-separator heights are merely suggested height and can vary depending on the device, sizes, materials, and numbers of the separator. The separator heights may be affected by the type and material of the device. For example, if the separator is used on a tablet the height may have to be considerably higher than that used for a phone due to the much larger surface area in order to maintain the minimum number of the dots.

There are numerous ways to align, configure and place the microdots. For example, they could be positioned sporadically and numerously about the entire inner case surface. Alternatively, they could be in a line down the center of the inner surface of the case and possibly down the sides, as shown in FIGS. 15-20. They could be positioned about the periphery of the inner surface of the case or they could be just randomly positioned about the inner surface of the case.

Features and embodiments of the present invention are numerous and diverse, extending beyond the detailed description and claims herein. For example, there are numerous other materials that could be used for the case and for the ridge or separator. The point is that the materials create a separation between the device and the case.

It is to be expressly understood that other embodiments are considered to be within the scope of the present invention as set forth in the claims. For example, the case can and will be used with a variety of devices, not just phones, but tablets, computers, phablets, and a variety of other electronic portable devices. The devices are limitless.

Moreover, component configurations and combinations of embodiments may diverge from specifications shown and described. Thus, the scope of the present invention includes various substitutions and assemblies among phone cases and electronic device cases beyond the particular embodiments illustrated and specified herein.

It is therefore contemplated that other embodiments not illustrated in the drawings or described herein are considered to be within the scope of the present invention as set forth in the claims. Accordingly, configurations and combinations of the components of the cases shown and described not specifically shown may diverge from those specified herein. The scope of the present invention thus includes any equivalent configuration or combination of the embodiments described and elements claimed.

The invention claimed is:

1. A case for a mobile electronic device, comprising:
a clear body having
an outer surface; and
an inner surface; where
said clear body covers at least a back side of said electronic device;
at least two linear separators formed on or within said inner surface of said clear body; where
said at least two linear separators are along the periphery of said case and said separators create an unobstructed space between said case body inner surface and said back side of said electronic device.

2. The case of claim 1 further comprising another separator that encompasses a camera lens and flash hole in said case to prevent particles, such as dirt and debris, from entering said space created by said another separator.

3. The case of claim 1 where said case body is polycarbonate.

4. The case of claim 3 where said at least two separators are made from the same material as said case body.

5. The case of claim 3 where said at least two separators are made from a different material from said case body.

6. The case of claim 1 where said case body is TPU.

7. The case of claim 6 where said at least two separators are made from the same material as said case body.

8. The case of claim 6 where said at least two separators are made from a different material from said case body.

9. The case of claim 1 where said space is approximately between 0.15μ and 0.35μ.

10. A case for a mobile electronic device, comprising:
a clear body having:
an outer surface; and
an inner surface; where
said clear body covers at least a back side of said electronic device;
at least two separators on said inner surface of said clear body; where
said at least two separators are formed from multiple ribs or ridges and where said ribs or ridges are along the periphery of said case and where said separators create an unobstructed space between said case body inner surface and said back side of said electronic device.

11. The case of claim 10 further comprising at least another separator that encompasses a camera lens and flash hole in said case to prevent particles, such as dirt and debris, from entering said space created by said another separator.

12. The case of claim 10 where said case body is polycarbonate.

13. The case of claim 12 where said at least two separators are made from the same material as said case body.

14. The case of claim 12 where said at least two separators are made from a different material from said case body.

15. The case of claim 10 where said case body is TPU.

16. The case of claim 15 where said at least two separators are made from the same material as said case body.

17. The case of claim 15 where said at least two separators are made from a different material from said case body.

18. The case of claim 10 where said space is approximately between 0.15μ and 0.35μ.

* * * * *